United States Patent [19]

Cors et al.

[11] Patent Number: 4,974,268

[45] Date of Patent: Dec. 4, 1990

[54] CHAIR BATHTUB

[75] Inventors: Mark W. Cors, Lodi; Edward P. Stevens; James A. McCormick, both of Menomonee, all of Wis.

[73] Assignee: Kohler Co., Kohler, Wis.

[21] Appl. No.: 419,933

[22] Filed: Oct. 11, 1989

[51] Int. Cl.[5] ..... A47K 3/022

[52] U.S. Cl. ..... 4/590; 4/567; 4/604

[58] Field of Search ..... 4/540, 546, 559, 560, 4/567–569, 571, 573, 574, 604, 611, 555–557, 589, 590

[56] References Cited

U.S. PATENT DOCUMENTS

| | | | |
|---|---|---|---|
| 2,714,725 | 8/1955 | Boone | 4/148 |
| 3,366,978 | 2/1968 | Jones | 4/540 |
| 3,562,821 | 2/1971 | Queen | 4/604 |
| 3,587,118 | 6/1971 | Compton | 4/604 |
| 3,832,740 | 9/1974 | McClarrin | 4/611 |
| 3,924,278 | 12/1975 | Ekman | 4/540 |
| 4,099,272 | 7/1978 | Sowder | 4/148 |
| 4,160,292 | 7/1979 | Kuether et al. | 4/604 X |
| 4,202,060 | 5/1980 | Touze | 4/556 |
| 4,399,569 | 8/1983 | Houle | 4/555 |
| 4,439,877 | 4/1984 | Houle | 4/604 X |

FOREIGN PATENT DOCUMENTS

| | | | |
|---|---|---|---|
| 1300987 | 12/1972 | United Kingdom | 4/604 |
| 2197586 | 5/1988 | United Kingdom | 4/555 |

*Primary Examiner*—Charles E. Phillips
*Attorney, Agent, or Firm*—Quarles & Brady

[57] ABSTRACT

A chair is provided having the capabilities of washing a person while seated therein. The chair has a chair body which includes an enclosed seat, a back and foot portion, as well as a arm portion. The foot portion is pivotally connected to the chair body and is configured to hold a quantity of water in a first position and to empty the water when in a second position. In a preferred embodiment, water orifices are positioned in both the upper back portion as well as the arm rest portion for bathing purposes.

11 Claims, 2 Drawing Sheets

CHAIR BATHTUB

BACKGROUND OF THE INVENTION

A. Field Of The Invention

This invention relates primarily to a bathing fixture which is especially suited to those people who have a difficult time entering and exiting from a standard type bathtub facility. More particularly, it relates to a chair type apparatus which has water outlets for directing water onto a person while the person is seated in the chair as well as a movable foot portion to collect and deliver the waste water to a drain.

B. Description Of The Art

As is well recognized, it is extremely difficult for many older or handicapped people to have access to bathing facilities such as a bathtub. Some shower facilities are now available wherein a person in a wheelchair can be conveyed inside the shower stall and then moved from the wheelchair onto a seat in the shower. This requires a greater than necessary amount of space, and leaves cleaning the feet still difficult for some persons.

As to bathtubs, there is the additional problem of the person being lowered to almost floor level and then having to be raised again. While there are seat type units which are hydraulically actuated for lowering and raising a person out of a bathtub, these require a connection to a water faucet and also require the person to be moved over the edge of the bathtub. Movable door configurations on such tubs have been tried, but often present sealing problems or cost problems. Thus, it can be seen that a need exists for an improved type of bathing fixture which is readily useable by older and handicapped people, and which takes up only the minimum space needed.

SUMMARY OF THE INVENTION

In one aspect, the invention provides a chair assembly having the capability of washing a person while the person is seated therein. The chair has a chair body with a seat and back portion. A foot well is connected to the lower portion of the chair body, and it is configured to hold a quantity of water therein when in a first position while at the same time bathing the feet of the person seated. There is at least one orifice positioned in or adjacent the chair body to direct water onto the person when the person is seated. It is connectable to a water supply means. There are also means operatively connected to the foot well to move the foot well from the first position to a second position, so as to permit easy access to and exit from the seat when the well is in the second position.

Preferably, the chair includes arm rest portions and the water orifices are selectively positioned around the inward perimeter of the chair body as well as in the arm rest portions. The chair can be connected to the water supply through water jets, or through a slot like outlet that provides a sheet of water. Also, the foot well preferably pivots on a horizontal axis parallel to the chair front.

In another embodiment, there are suitable openings placed in the seat of the chair to serve as drain holes to provide a sitz bath. Similarly, a suitable drain hole can be placed in the foot portion. In the alternative, water can be collected in the foot well, and then dumped en mass at the end of the bath.

Also preferably, the water supply orifices are connected to a source of soapy water to be used in conjunction with a high pressure water line so as to cause the soapy water to be directed onto the person at a high velocity for cleaning purposes. Subsequently, and automatically, a low pressure water source can be utilized without the soap in a rinse phase.

The objects of the invention therefore include:

a. Providing a bathing fixture of the above kind which is readily accessible for bathing purposes.

b. Providing a bathing fixture of the above kind which resembles a chair and has water outlets disposed in the chair body so as to provide water contact with a person sitting therein.

c. Providing a bathing fixture of the above kind which has a movable foot rest which acts to collect water, dump waste water, and provide ready access.

d. Providing a bathing fixture of the above type wherein the chair portion of the fixture can provide a sitz bath.

e. Providing a bathing fixture of the above type wherein suitable means are provided for raising and lowering the foot portion.

f. Providing a bathing enclosure of the above kind wherein the water orifices can be utilized to provide both a high velocity stream of soapy water as a wash phase as well as a lower velocity rinse water phase.

g. Providing a bathing fixture of the above kind which can be easily manufactured, installed and operated in a relatively small area.

These and still other objects and advantages of the invention will be apparent from the description which follows. In the detailed description below, the preferred embodiments of the invention will be described in reference to the accompanying drawings. The embodiments do not represent the full scope of the invention. Rather the invention may be employed in other embodiments. Reference should therefore be made to the claims herein for interpreting the breadth of the invention.

DESCRIPTION OF THE PREFERRED EMBODIMENT

Figure 1:
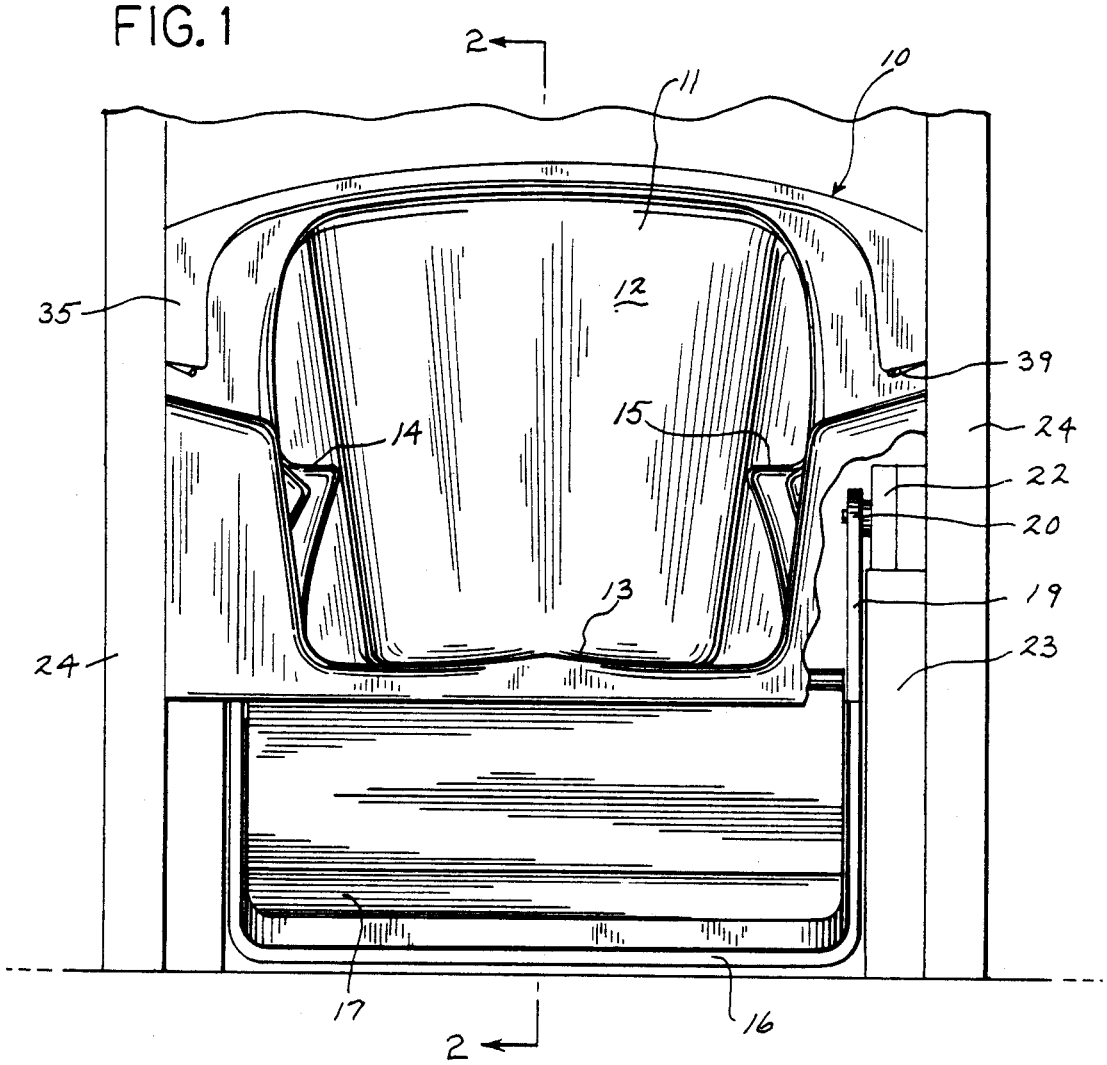
FIG. 1 is a front elevational view, partially fragmented, showing a chair bathtub assembly constituting a preferred embodiment of the invention.

The chair bathtub generally 10, has a chair body 11 preferably molded in a one piece construction from an acrylic or other suitable plastic material. The chair body includes a sloping back portion 12, an angled seat portion 13, as well as the arm rest portions 14 and 15. A movable foot well or trough-like portion 16 is positioned at the lower front of the chair body 11 and there is a pivotable support arm 19 attached thereto. Support arm 19 is pivotally mounted to a mounting block 22 (see FIG. 1) by a pivot pin 20, the mounting block 22 being supported by the housing column 23. The bathtub chair 10 is suitably contained in a stall defined by three vertical walls 24.

Figure 2:
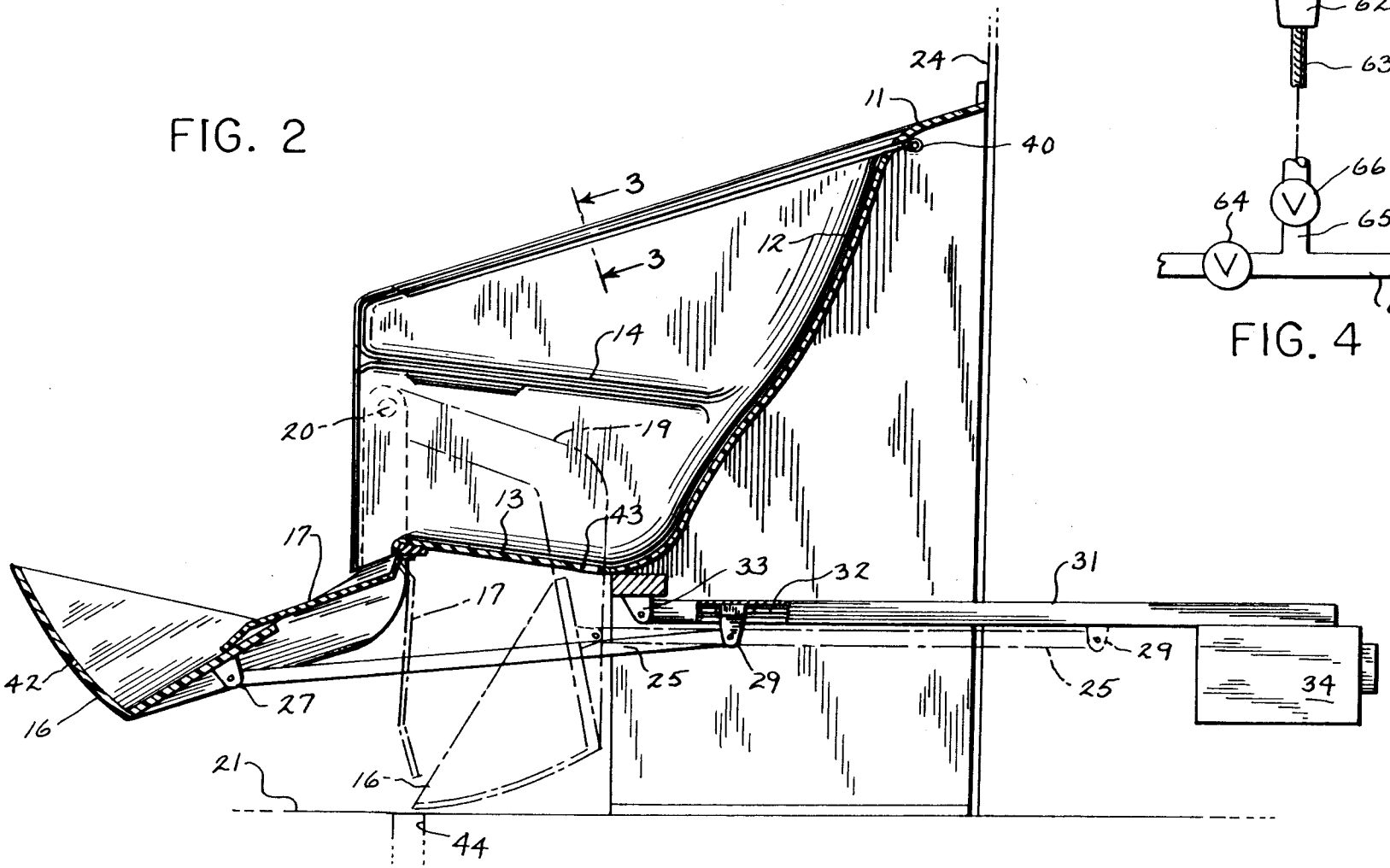
FIG. 2 is a vertical sectional view of the chair bathtub shown in FIG. 1, taken on plane 2—2 of FIG. 1.

As best seen in FIG. 2, there is pivotally connected to the foot well 16 a push/pull rod 25 such as by the pivot bracket 27. At the opposing end, rod 25 is pivotally connected to a slideable bracket 29, which in turn is threadably connected to the drive screw shaft 32. A housing 31 is provided for the screw shaft 32 as well as a portion of the movable bracket 29. It is connected at one end to the bracket 33 and at the other end to the drive motor 34. The previously described mechanism for moving the foot portion 16 is similar to that employed in opening and closing garage doors.

It is seen in conjunction with the broken line showing of the foot portion 16 in FIG. 2 that the well 16 is movable from an upward "first" position as shown in solid lines to a lowered "second" position as shown in broken lines. The solid line position is that employed when a person is already seated in the chair 10 with one's feet positioned in the foot portion 16 in a foot rest position. Overflow wash and rinse water would then flow from the seat portion 13 over the flap portion 17 and consequently into the foot portion 16. Openings such as 43 can also be disposed in the seat portion 13 and then linked (by means of a tube not shown) to floor drain 44. Preferably, there are two such openings which can be covered by the buttocks to provide a sitz bath. Another opening 42 can be provided in the foot portion 16 so as to control the level of accumulation of water in the foot bath.

In order to remove the wash and rinse water from the foot portion 16, it is simply moved to the lowered position as indicated in the broken lines by the movement of the push/pull rod 25 to the broken line position. An electric switch suitably mounted on a wall 24 can control this function. The water will be emptied onto the floor 21 and then go down the drain hole 44. It is understood that the floor has a slope toward the drain 44 in the area under the foot portion 16 in both the solid and broken line showings.

Figure 3:
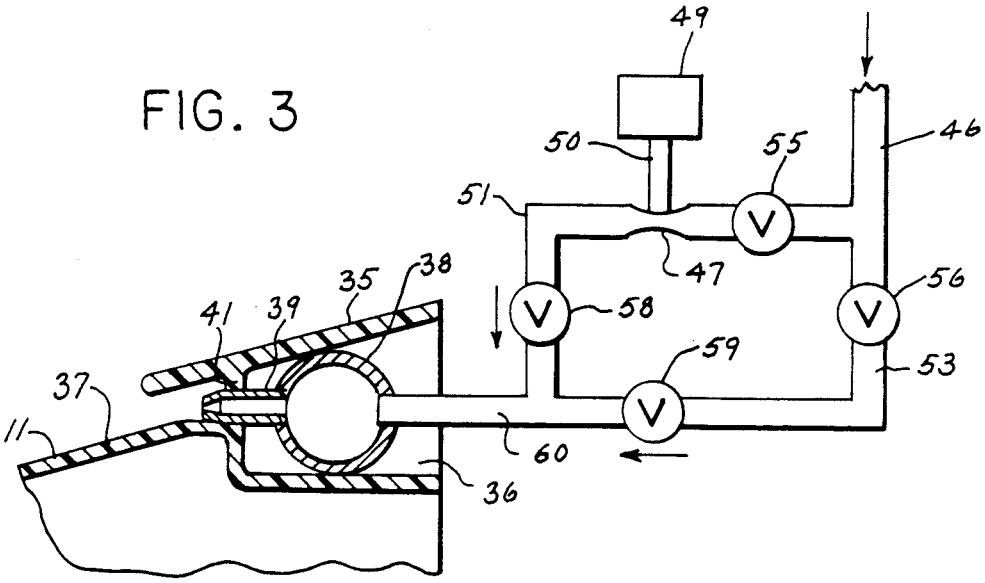
FIG. 3 is a sectional view taken along line 3—3 of FIG. 2 and diagrammatically showing a wash and rinse water supply source connected to the chair.

Referring to FIG. 3, there is shown an example nozzle 39 of the jet type for directing water over a person seated in the chair body 11. The end of the nozzle 39 is positioned through a wall 41 extending between the upper tapering wall 35 of the chair body and the lower sloping side wall 37. There can be a plurality of nozzles 39 connected to a tubular manifold 38 which extends peripherally around and under the upper wall 35 and housed in the cavity 36. In a similar manner nozzles 39 may be disposed in the arm portions 14 and 15 and direct water inwardly toward a person seated in the chair body 11.

The tubular manifold 38 is connected to a source of water as indicated by the inlet line 46. It supplies a low pressure line 53 regulated by the valve 56 as well as a high pressure line 51 regulated by the valve 55. The high pressure line 51 has a venturi section 47 and a soap supply 49 communicates with the venturi 47 so as to supply soapy water to the nozzle 39 at a high velocity. Suitable check valves such as 58 and 59 are provided in the high and low pressure lines 51 and 53, respectively. Automated or manual controls can control this system. If desired, some of the nozzles 39 can be replaced with slot like nozzles which supply a sheet of water. This is indicated at 40 in FIG. 2 and would provide a flow of water down the back of the bather.

From the foregoing it is seen that a washing liquid such as soapy water is supplied by closing the valve 56 and opening the valve 55 at a high pressure setting. As a result, water flows into the high pressure line 51 and draws a soap material from the supply 49. The soapy water will then flow from the nozzles 39 onto the body of the person sitting in the chair 11. Subsequently, the valve 55 will be closed and valve 56 opened which is a lower pressure regulating valve so that rinse water can flow into the manifold 38 and out the nozzles 39 in the previously described manner. Water flows out of the chair 11 and over the flap 17 into the foot portion 16 where it can be emptied as previously described. Because the user is seated and the feet are elevated, most users will be able to reach and wash their own feet.

Figure 4:
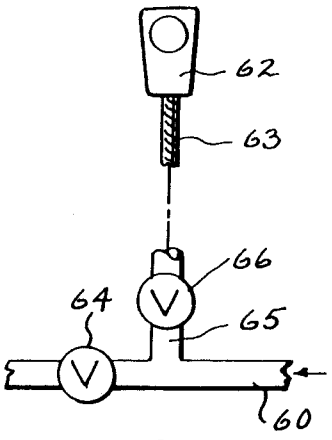
FIG. 4 is a diagrammatic view illustrating a hand held shower for use with the chair bathtub.

As shown in FIG. 4 of the drawings, there can also be a hand held shower unit 62 which can be suitably connected to the common water line 60 such as with the shower line 65 and the flexible hose 63, and then hung on a side wall 24 adjacent the chair. It can be operated separately or in conjunction with the flow of water through the nozzles 39 and with the high and low pressure water lines 51 and 53, respectively. In the instance where sole operation of the shower unit is desired, a valve 64 in the common water line 60 would be closed. The shower unit 62 can be turned off completely by the valve 66.

While the sloping back portion 12 has not been shown as being movable, it could be fabricated independently of the chair body 11 and attached in a movable manner such as in a typical recliner chair. Further, the seat portion is shown as sloping inward and with a drain hole 43. If desired, the seat could be made to slope outwardly and without the drain hole 43 so as to provide proper drainage.

We claim:

1. A bathing chair assembly having the capability of washing a person while the person is seated, comprising:

a chair body having a seat and a back portion;

a foot well connected to a lower portion of the seat portion the foot well having a trough-like configuration to hold a quantity of water therein when in a first raised position for bathing the feet of the person seated;

at least one orifice positioned adjacent to or in the chair body to direct water onto the person when the person is seated in the chair body, the orifice being connectable to a water supply means; and means operatively connected to the foot well to move the foot well independently of and relative to the seat portion from the first raised position to a second lowered position under said seat portion so as to permit easy access to and exit from the seat when the well is in the second lowered position.

2. The chair as defined in claim 1, wherein there are a plurality of water orifices disposed along an upper section of said back portion.

3. The chair as defined in claim 1, further including arm rest portions disposed on lateral sides of the seat.

4. The chair as defined in claim 3, wherein there are a plurality of water orifices disposed in both the back portion and the arm rest portions.

5. The chair as defined in claim 4, wherein at least some of the water orifices are in the form of water Jets.

6. The chair as defined in claim 4 wherein the water orifices and the water supply means are constructed and arranged to provide a sheet of water for flowing down the back portion of said chair body.

7. The chair as defined in claim 1 wherein there is disposed at least one opening in the seat portion.

8. The chair of claim 1, wherein the foot well pivots between the first and second position along a substantially horizontal axis.

9. The chair as defined in claim 1 wherein there is at least one opening in the foot well.

10. The chair of claim 1, further comprising a water supply connected to the orifice.

11. A bathing chair having the capabilities of washing a person while seated therein, comprising:

a chair body having an enclosed seat and back portion;

a pivotal foot portion operatively connected to said seat portion, said foot portion having a trough-like configuration to hold a quantity of water therein when in a first raised position and adapted to be connected to operating means to move said pivotal foot portion independently of and relative to said seat portion from a first raised position to a second lowered position under said seat portion for emptying water therefrom; and orifices for water selectively positioned in said chair body to direct water onto the seated person and adapted to be connected to a water supply means.

* * * * *